US009127824B2

(12) United States Patent
Zhang et al.

(10) Patent No.: US 9,127,824 B2
(45) Date of Patent: Sep. 8, 2015

(54) LED LAMP

(75) Inventors: Fa-Wei Zhang, Ningbo (CN); Tao-Lin Zhu, Ningbo (CN); Zhao-Yong Zheng, Ningbo (CN); Wan-Jiong Lin, Ningbo (CN)

(73) Assignee: Self Electronics Co., Ltd., Ningbo (CN)

( * ) Notice: Subject to any disclaimer, the term of this patent is extended or adjusted under 35 U.S.C. 154(b) by 179 days.

(21) Appl. No.: 13/988,132

(22) PCT Filed: Dec. 23, 2010

(86) PCT No.: PCT/CN2010/002138
§ 371 (c)(1), (2), (4) Date: Jun. 10, 2013

(87) PCT Pub. No.: WO2012/065285
PCT Pub. Date: May 24, 2012

(65) Prior Publication Data

US 2013/0308319 A1 Nov. 21, 2013

(30) Foreign Application Priority Data

Nov. 19, 2010 (CN) ..... 2010 1 0565948

(51) Int. Cl.
*F21V 3/00* (2015.01)
*F21V 1/00* (2006.01)
(Continued)

(52) U.S. Cl.
CPC ... *F21V 1/00* (2013.01); *F21S 8/02* (2013.01); *F21V 5/00* (2013.01); *F21V 11/06* (2013.01); *F21V 13/14* (2013.01); *F21V 29/004* (2013.01); *F21V 29/773* (2015.01); *F21V 5/04* (2013.01); *F21V 7/0091* (2013.01); *F21Y 2101/02* (2013.01)

(58) Field of Classification Search
CPC ..... F21S 8/02
USPC ..... 362/311.01
See application file for complete search history.

(56) References Cited

U.S. PATENT DOCUMENTS

2001/0030866 A1* 10/2001 Hochstein ..... 362/294
2001/0040804 A1* 11/2001 Marquardt et al. ..... 362/240

FOREIGN PATENT DOCUMENTS

EP 1710495 A1 * 10/2006

*Primary Examiner* — Anh Mai
*Assistant Examiner* — Hana Featherly
(74) *Attorney, Agent, or Firm* — Wang Law Firm, Inc.; Li K. Wang; Stephen Hsu

(57) ABSTRACT

A LED lamp includes a number of lenses each of which includes a light emitting surface and a plurality of shades mounted on the light emitting surface. Each of the shades includes a hole whose sectional area in radial direction is equal to that of the light emitting surface. An axial height of the hole follows the formula $$H_\varphi = \frac{\phi_{max}}{\tan\theta_{max}},$$

wherein $H_\phi$ is the axial height of the hole, $\phi_{max}$ is a diameter value of the light emitting surface, and $\theta_{max}$ is an output angle of the lens. Accordingly, a work area of the anti-glare LED lamp can be extend the most thereof since the shades block the stray light of a glare area of the LED lamp and strictly separates the work area from the glare area, and no stray light shot into eye in any areas. Therefore, the anti-glare LED lamp can achieve light distribution as designed without glare under cooperation of the lenses and the shades.

10 Claims, 8 Drawing Sheets

(51) Int. Cl.

| | |
|---|---|
| ***F21S 8/02*** | (2006.01) |
| ***F21V 11/06*** | (2006.01) |
| ***F21V 13/14*** | (2006.01) |
| ***F21V 29/00*** | (2015.01) |
| ***F21V 5/00*** | (2015.01) |
| ***F21V 29/77*** | (2015.01) |
| *F21V 5/04* | (2006.01) |
| *F21V 7/00* | (2006.01) |
| *F21Y 101/02* | (2006.01) |

LED LAMP

CROSS REFERENCE TO RELATED APPLICATION

This application is a national phase application of and claims the benefits of PCT Application No. PCT/CN/2010/002138, filed on Dec. 23, 2010.

BACKGROUND

1. Technical Field

The disclosure relates to electrical lighting devices, and more particularly to an LED lamp using at least one single-chip or multi-chip light-emitting-diode ("LED"), and a shade module which minimizing glare.

2. Description of the Related Art

For years, people have used traditional incandescent or fluorescence lighting apparatus in order to address their interior lighting concerns. However, such lighting apparatus presents a number of drawbacks. For example, the popular halogen apparatus presents the following drawbacks, such as relatively high power consumption, inefficiency of light dispersion due to the placement of its metal shield in the line sight of the halogen bulb, and its limited effectiveness in preventing glare from the halogen bulb.

Recently, a number of LED lighting apparatuses have been designed to replace the halogen apparatus, as well as other traditional incandescent or fluorescence lighting apparatuses. Typically, in such LED lighting apparatuses, the LED light source is located at the center of a reflector with its light emission directed outward from the reflector. Additional, there are LED lighting apparatuses which use multiple LEDs with their light emissions directed outward from one or more reflectors. These configurations are unable to achieve narrow beam angles, and result in considerable glare since observers are not shielded from the LED light source. Further, these configurations inefficiently distribute heat; thereby, making the use of high-powered LEDs in these configurations practically prohibitive.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

Figure 1:
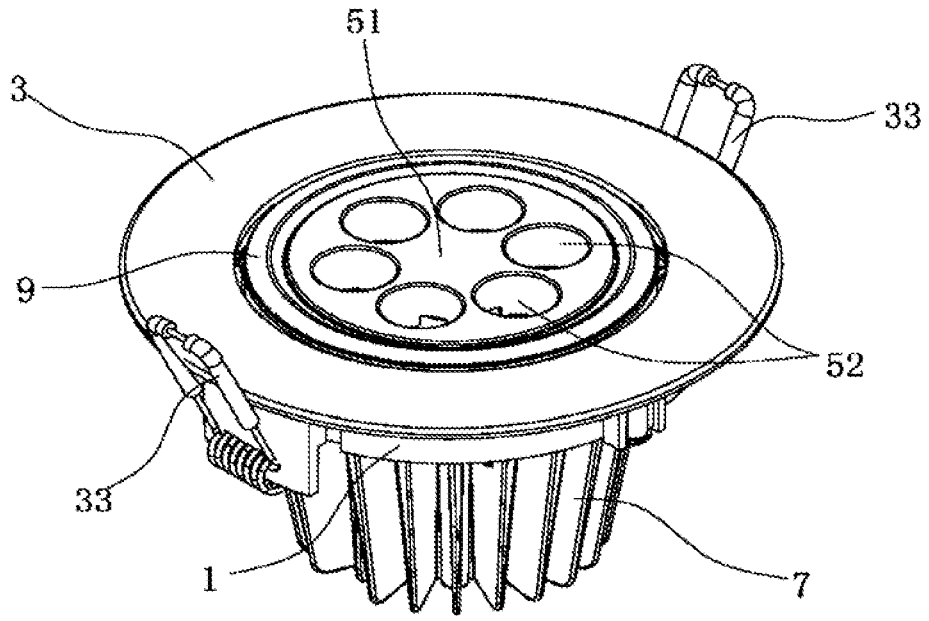
FIG. 1 is an isometric configuration view of an LED lamp in accordance with one embodiment of the disclosure (plan view).
Figure 2:
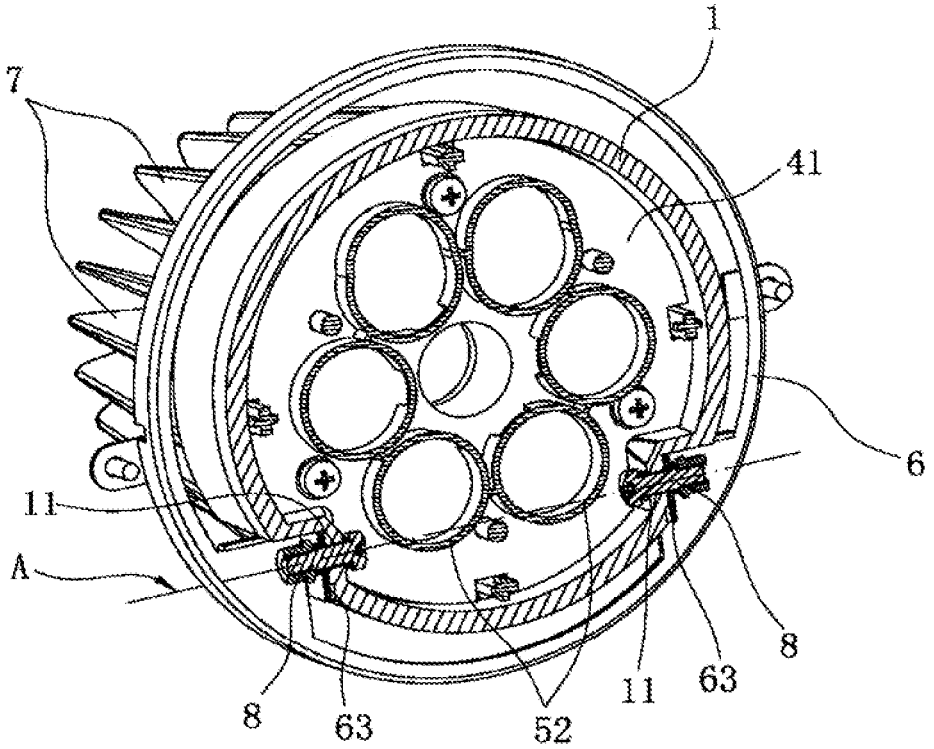
FIG. 2 is an isometric section view of the LED lamp of FIG. 1 (no cover).

The disclosure is illustrated by way of example and not by way of limitation in the figures of the accompanying drawings. It should be noted that references to "an" or "one" embodiment in this disclosure are not necessarily to the same embodiment, and such references mean at least one.

Referring to FIGS. 1-12, a LED lamp according to an embodiment is shown. The LED lamp includes a house 1, a light module 2 mounted in the house 1, lens module 4 received in the house 1 along an optical axis of the light module 2, a shade module 5 arranged in the lens module 4, a light frame 3 mounted in front of the house 1, and a ring 6 surrounding the house 1.

Figure 11:
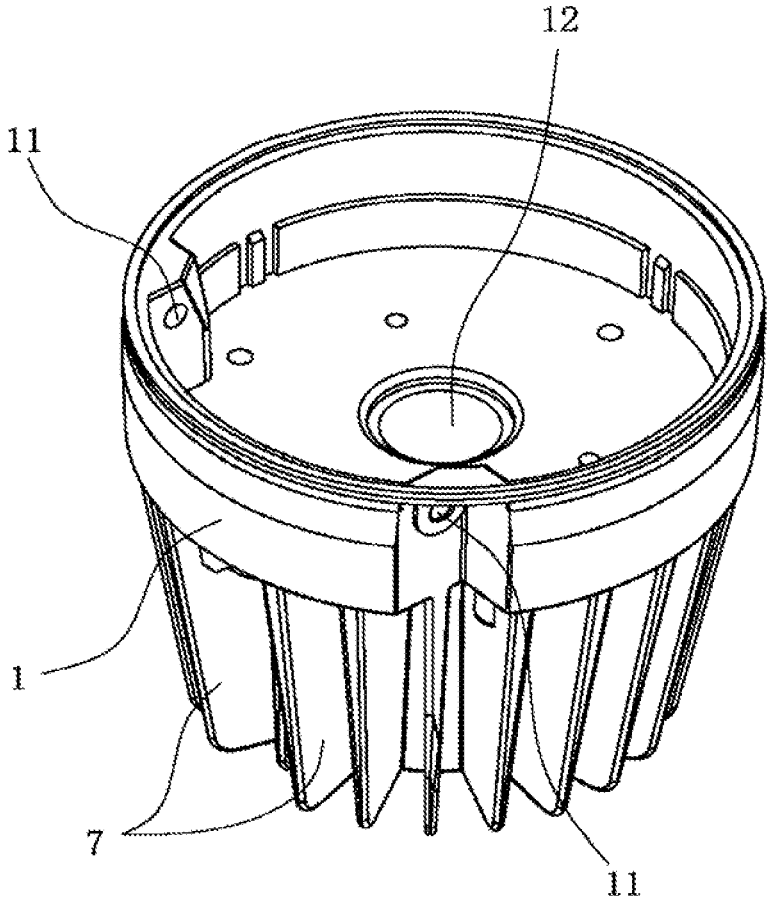
FIG. 11 is an isometric view of a house of the embodiment.

Referring to FIG. 11 together with FIG. 1, the house 1 has a cup-shaped structure and includes a number of heat sinks 7 around outer surface thereof, a first through hole 12 opened along a circumference axis thereof, a place for mounting the light module 2, and two first pin holes 11 being respectively opened in two side walls of the periphery thereof. The house 1 may be manufactured via extrusion molding process and may be formed of aluminum, aluminum alloy, and so on. In the present embodiment, the house 1 is made of aluminum alloy for light-weight. The heat sinks 7 extend from the outer surface of the body of the house 1 against a center of the house 1 and are integratedly manufactured with a body of the house 1. The first through hole 12 is opened and passes through the body of the house 1 for effectively dissipating heat. The two first pin holes 11 are eccentrically arranged with a centre of the house 1 and opened on the periphery thereof. The two first pin holes 11 are symmetric with the circumference axis of the house 1. More detailed explanation about the two first pin holes 11 will be described later.

Figure 3:
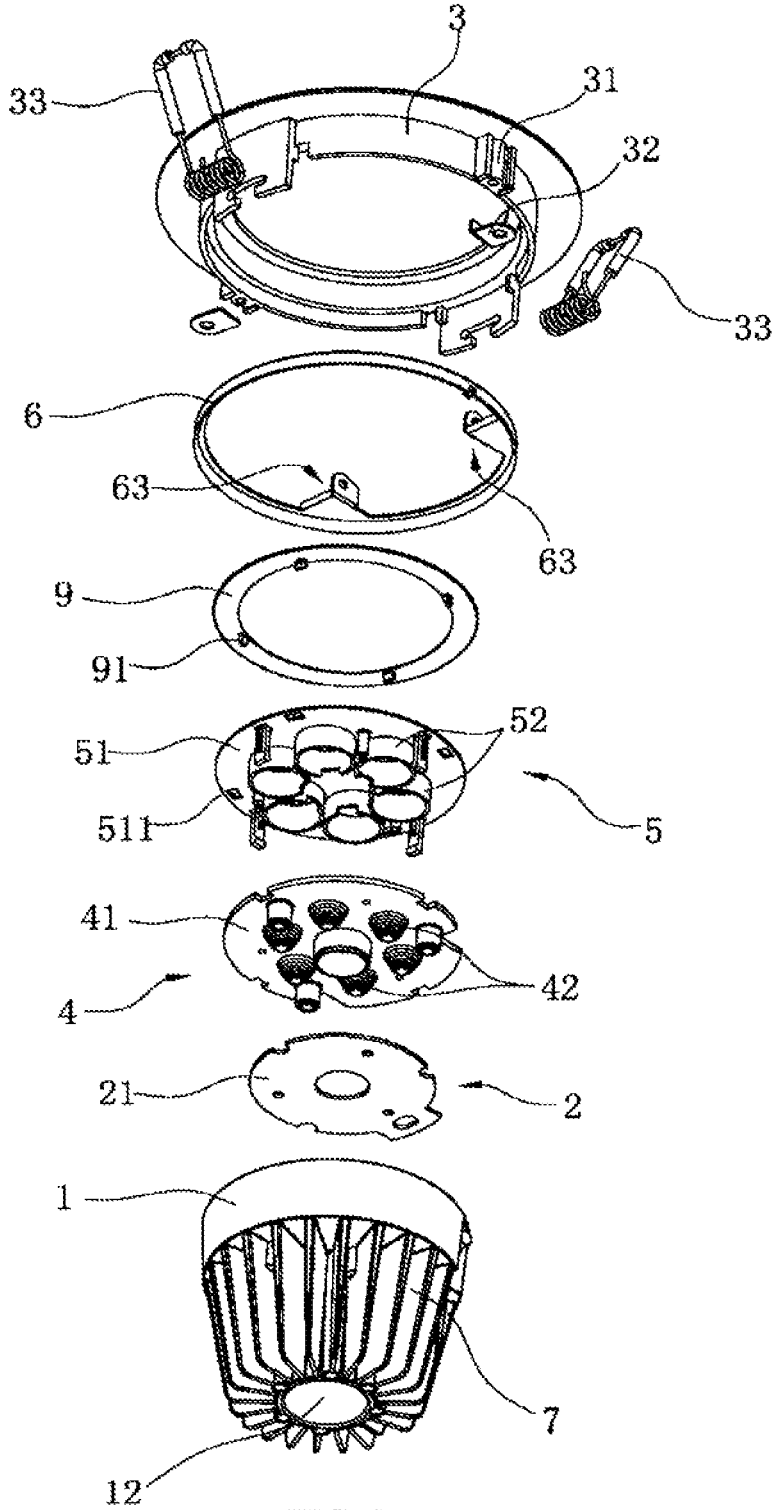
FIG. 3 is an isometric explored view of the embodiment.
Figure 6:
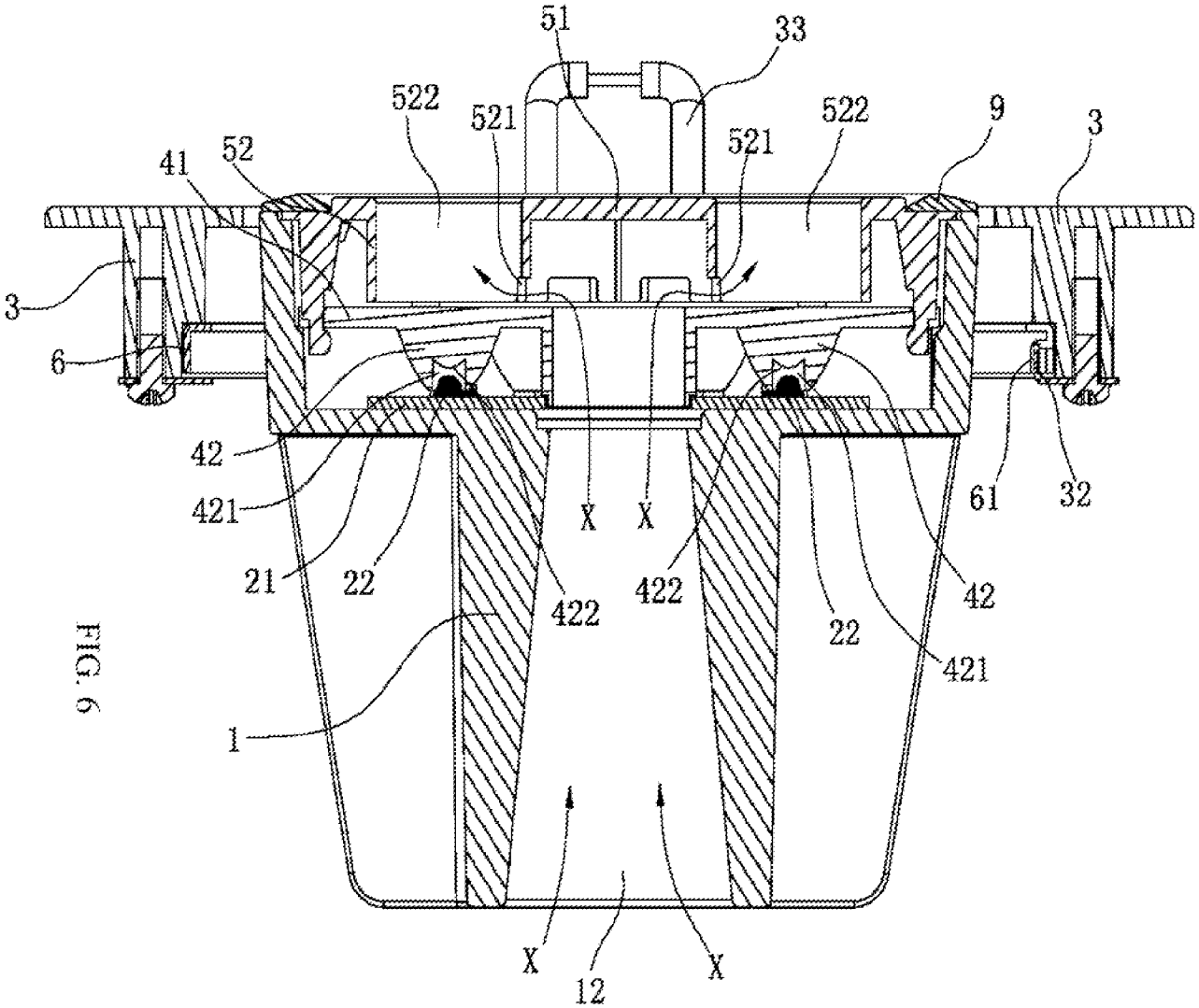
FIG. 6 is a section view of the embodiment.
Figure 7:
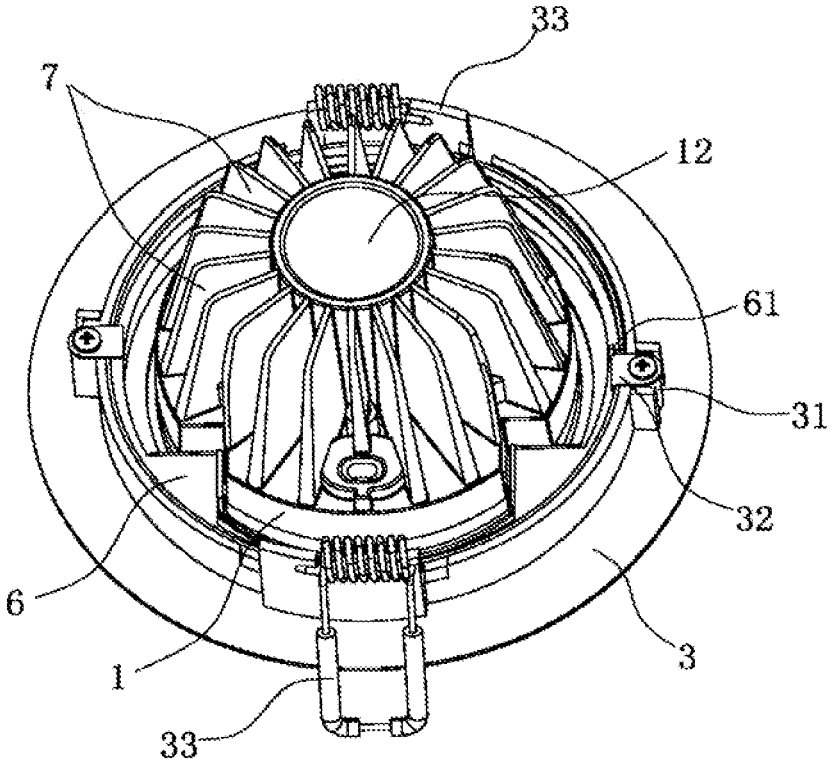
FIG. 7 is a second isometric view of the LED lamp of FIG. 1 (rear view).
Figure 8:
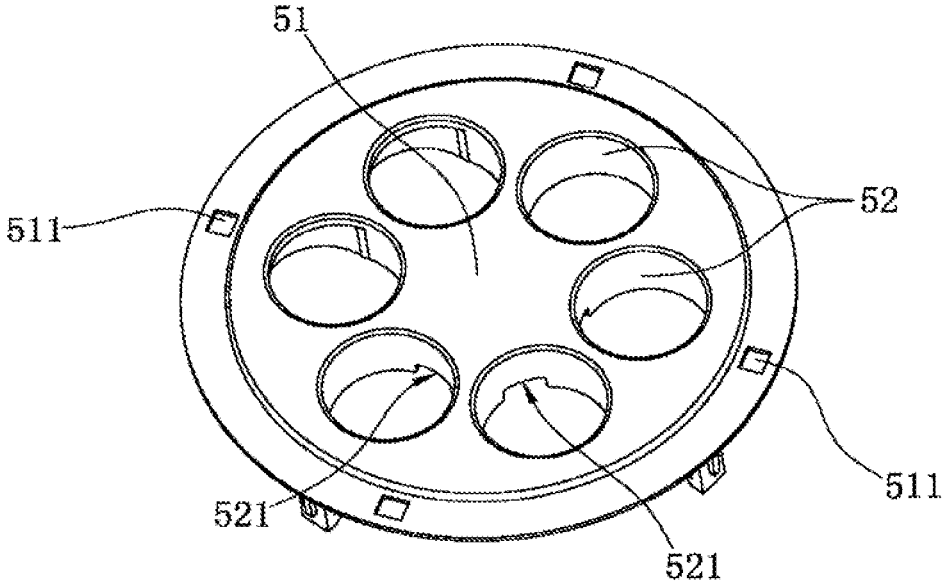
FIG. 8 is a first isometric view of an a shade module of the embodiment.

Referring to FIG. 3 and FIG. 6 together with FIG. 1, the light module 2 is mounted in the house 1 and includes a printed circuit board (PCB) 21, and a number of LEDs 22 mounted on the PCB 21 and electrically connected to the printed circuit board 21. Understandably, the light module 2 further includes other electronic components, such as capacitor, inductor, diode, transistor, and so on. For a person skilled in the art, the electronic components are well known. The PCB 21 is installed on the place of the house 1 via some fasteners, such as screws, or pin, thereby fixing the light module 2 in the house 1. The LEDs 22 are well known for a person skilled in the art and are not detailedly described. In the embodiment, the LED lamp has 6 LEDs 22. The light module 2 further includes a second through hole 211 which is opened along the circumference axis of the house 1 and is used for connecting with the first through hole 12. The LEDs 22 of the light module 2 are arranged on the PCB 21 in such a manner that the 6 LEDs 22 are surround the second through hole 211 with a substantially regular interval.

The lens module 4 is received in the house 1 and disposed in front of the light module 2. The lens module 4 includes a lens base 41, a number of lenses 42 disposed on the lens base 41, and a third through hole 411 opened in the lens base 41 along the central circumference axis of the house 1. The lens base 41 is configured for assembling the lens module 4 into the house 1 via some fasteners, for example, screws and so on. The lens base 41 is integratedly manufactured with the lenses 42 via extrusion mold process. The lenses 42 are responsive to the LEDs chips 22 and are light distribution lenses for regulating forward light of the LEDs 22 disposed in the center thereof. Each of the lenses 42 includes a light emitting surface with a circular shape in plan view and is made of a transparent acrylic material and the like and is formed like a mortar of conic shape of which circular portion is formed upward. A big end of the lenses 42 is connected to the lens base 41, and the big end of the lenses 42 works as the light emitting surface. There is a diameter value for the light emitting surface to determine beam widths thereof. A maximum diameter of the light emitting surface is represented with the reference numeral $\phi_{max}$. In the section view of the lenses 42, an output angle between light path of light emitted from the outermost boundary of the light emitting surface and the optical axis thereof is represented with the reference numeral $\theta_{max}$. In other words, the output angle is a maximum angle in all of angle between the light paths and the optical axis. Each of the lenses 42 further includes an LED recess 421. The LED recess 421 is opened in a small end of each of the lenses 42 along the longitudinal direction thereof and is provided so as to efficiently emit the light from the LEDs 22 at the center thereof. According to the embodiment of the present disclosure, the lens module 40 has 6 lenses 42 in corresponding with the 6 LEDs 22. The LEDs 22 are received in the LED recess 421 respectively of the bottom of the lenses 42. The third through hole 411 has a section area along radial direction as same as that of the first through hole 12 and the second through hole 211. Understandably, the six lenses 42 are arranged on the lens base 41 in such a manner that the six lenses 42 surrounded the third through hole 411 with a substantially regular interval.

Figure 9:
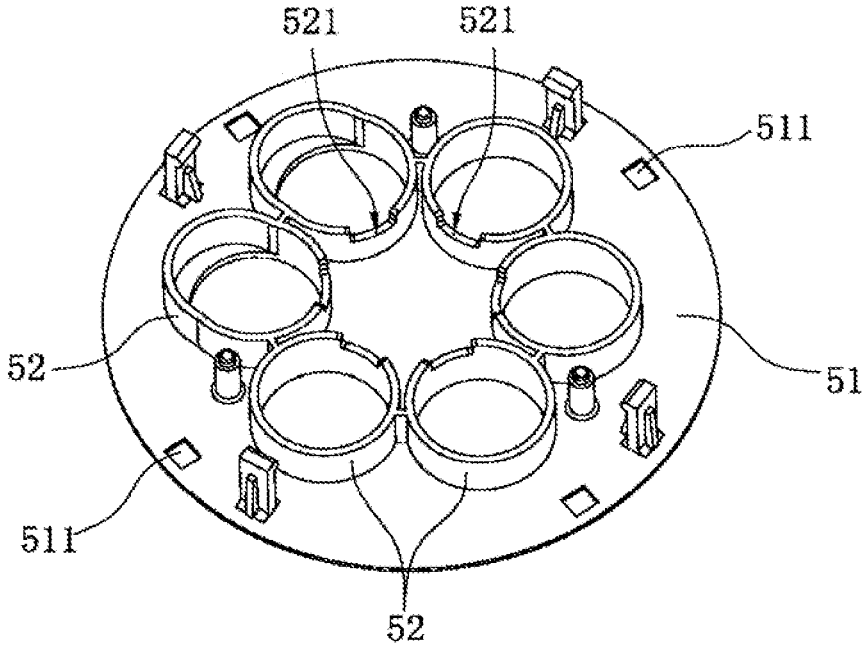
FIG. 9 is a second isometric view of the shade module of FIG. 8 of the embodiment.
Figure 10:
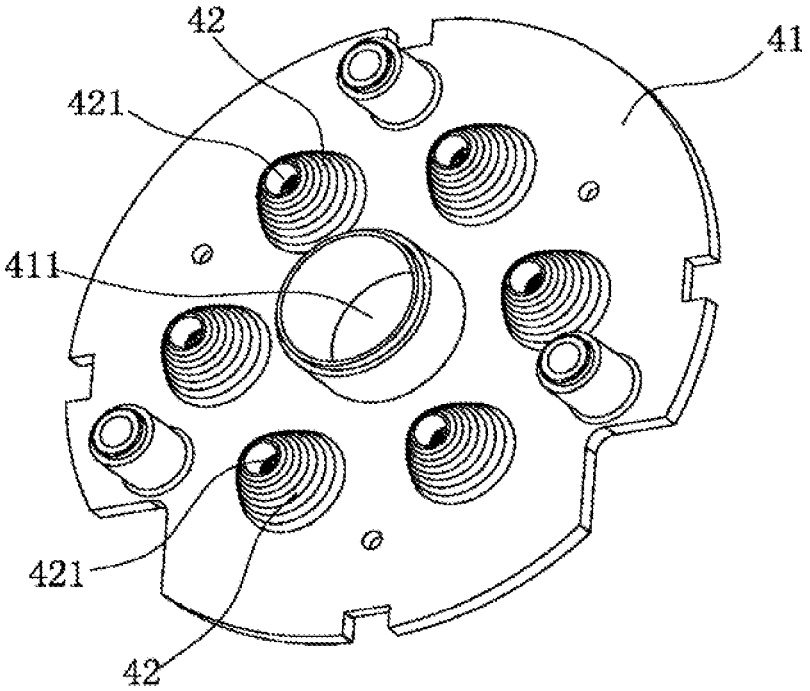
FIG. 10 is an isometric view of a lens module of the embodiment.
Figure 12:
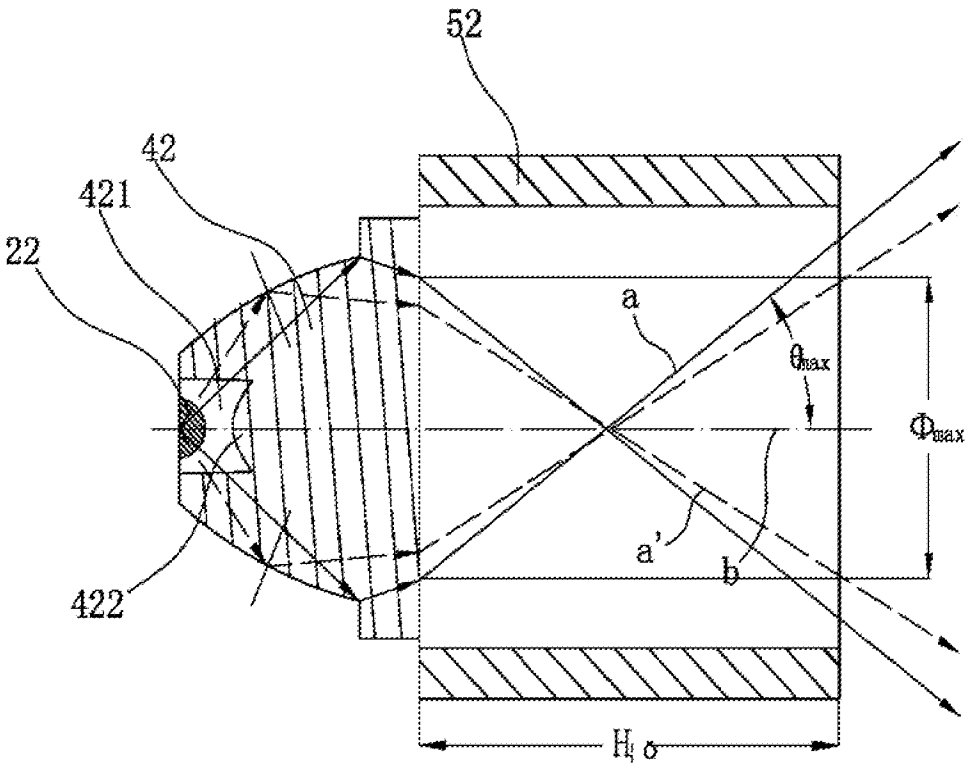
FIG. 12 is a light path view of the embodiment.

The shade module 5 is received in the house 1 and is disposed in front of the lens module 4. The shade module 5 includes a shade base 51 and a plurality of shades 52 formed in integrated with the shade base 51. The shade module 5 is made of a-plastic material and the like. The shade base 51 is designed for assembling the shade module 5 into the house 1 and supporting the shades 52. The shades 52 are mounted on the emitting forward of the light emitting surface and are responsive to the lenses 42. The bottom of the shades 52 touch the lens base 41. Each of the shades 52 includes a hole whose sectional area in radial direction is equal to that of the light emitting surface. In order to obstruct glare of the light module 2, an axial height $H_\phi$ of the hole must follow the below formula:

$$H_\varphi = \frac{\phi_{max}}{\tan\theta_{max}},$$

as shown in FIG. 12. The hole may be formed like some different section shape, such as circle, elliptic, polygon, and so on. When the hole of the shades 52 has the circle shape, a radius value of the circle shape equals to the maximum radial of the light emitting surface of the lenses 42. When the hole of the shades 52 has the elliptic shape, a minor axis of the elliptic shape has a length of equal to the maximum radial of the light emitting surface of the lenses 42. When the hole of the shades 52 has the polygon shape, a radial value of incircle of the polygon shape is equal to the maximum radial of the light emitting surface of the lenses 42. In the present embodiment, the hole is formed in circle shape, the diameter thereof is equal to the maximum diameter of the light emitting surface, thereby shielding glare emitted from the LEDs 22. As shown in FIG. 9, the hole further includes at least an open 521 disposed at the bottom thereof for building at least an air passage between the open 521 and the first, second, and third through hole 12, 211, and 411 so as to improve heat dissipation, thereby elongating the lift-span of the LED lamp.

Figure 4:
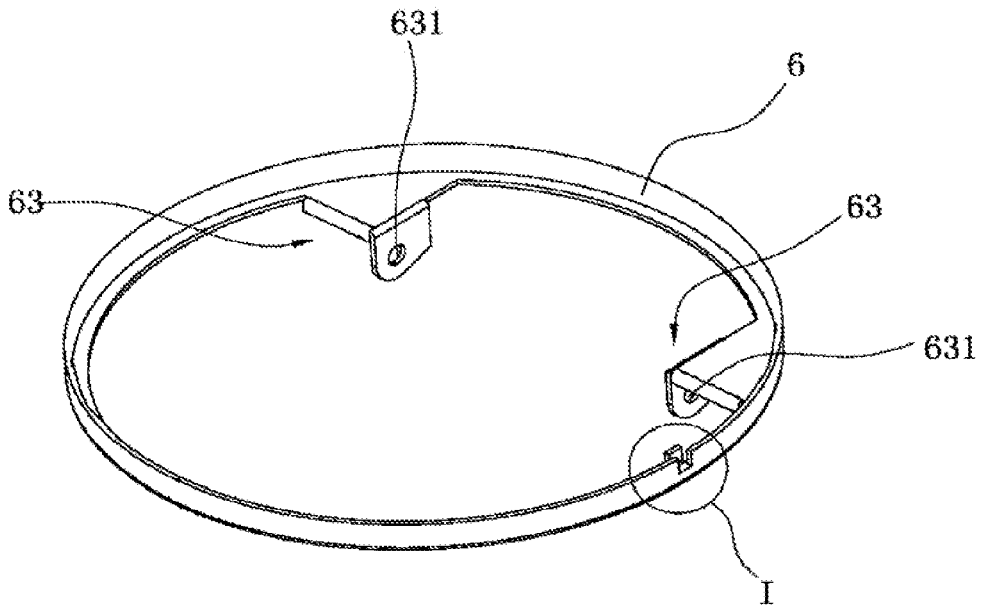
FIG. 4 is a configuration view of a ring of the embodiment.
Figure 5:
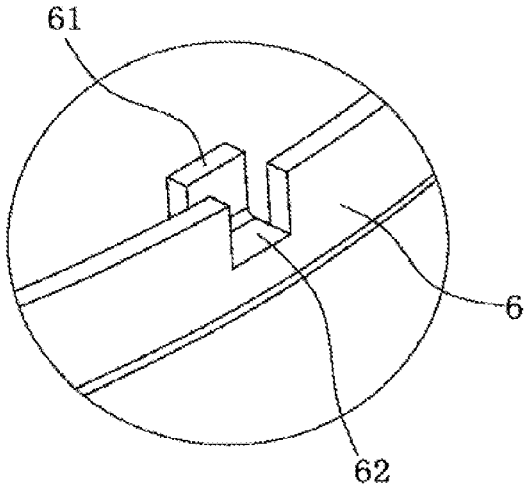
FIG. 5 is a partial enlarged view of the ring of FIG. 4 in I.

In order to extend effective illuminated area of the LED lamp, it provides the ring 6 for finishing this job. The ring 6 is connected to the shade module 5 and rotates around the shade module 5. The ring 6 is sheathed with the outer side of an end of the house 1, therefore, has an inner diameter as same as external diameter of the end of the house 1. Referring to FIG. 4, and FIG. 5, the ring 6 includes two arms 63 formed in an inner side thereof in response to the two first pin holes 11 respectively and two second hinge holes 631 respectively opened in the two arms 63. The two second hinge holes 631 are eccentrically arranged with a center of the ring 6 in correspondence with the first pin holes 11. Connection between the two first pin holes 11 is eccentrically arranged with the center of the ring 6. The ring 6 further includes a stopper 61 which extends towards a center thereof. The stopper 61 is formed in an L-shape. More detailed explanation will be given later.

Referring to FIG. 1 again, the LED lamp further includes a shaft 8 respectively crossing through the first pin holes 11 and the second hinge holes 631 and configured for joining the house 1 with the ring 6. Since the first pin holes 11 are respectively and eccentrically disposed in the house 1, the house 1 can rotate around the shaft 8 so as to change a radiation angle of the LED lamp over a wide range.

The light frame 3 is disposed in front of the house 1 and includes a body, at least two arms 31 arranged in the body with regular interval, and two elastic clips 33 disposed in the body. The body has a T-shaped section structure and includes an inner horizontal side, an outer horizontal side, and a perpendicular side. The inner horizontal side is used for clipping the ring 6. The outer horizontal side is used for assembling the LED lamp onto a ceiling with the two elastic clips 33. The light frame 3 further includes two limiting parts 32 perpendicularly extending from the perpendicular side toward the center thereof. The limiting parts 32 are located on the arms 31 respectively and are formed in a reverse L-shaped. The at least two arms 31 are disposed on the perpendicular side and are opened a screwed hole for amounting the limiting parts 32 via screws. According to the present embodiment, the light frame 3 has two arms 31 and two limiting parts 32. When the house 1 together with the ring 6 rotated around the circumference axis thereof, the limiting part 32 is used to block against the stopper 61 of the ring 6 so as to determine a rotating angle of the house 1 which less than 360 degree.

The shade module 5 of the anti-glare LED lamp is connected with an end cap 9 like annular. The end cap 9 includes a plurality of clips 91 formed thereon. The shade base 51 of the shade module 5 includes a plurality of grooves 511 formed therein along the periphery thereof. The clips 91 insert into the grooves 511 to connect the end cap 9 to the shade module 5 so as to close the bottom of the shade module 5. The diameter of the end cap 9 is equal to that of open of the house 1 for just right receiving the end cap 9 into the open of the house 1.

Primarily, it needs to explain the generation principle of glare without the shade module 5. In a section of luminance area, it can be divided into three areas. One is glare area, second is work area, and others is dark area. The glare area means that when a person gets into the glare area, some stray light emitted from the LEDs 22 is seen or shot into eye even if the person does not stare at the LEDs 22 directly. Therefore, the stray light is not need and should be cancelled as far as possible. The work area means that when a person gets into the work area, bright light emitted from the LEDs 22 does not shot into eye due to the eyelid of the eye only when the person stares at the LEDs 22 directly. In other words, when the person looks at the front horizontally and looks at the feet, the bright light which may causes people discomfort does not get into eye therein. The dark area means that whether a person stares at the LEDs 22 or not, light emitted from the LEDs 22 does not shine on it always. In the traditional lamp, they don't efficiently distinguish the work area and the glare area. As a result, the stray light of the glare area do not be shielded in order to have larger plane of lamination. On the other hand, for completely shield the stray light, the work area is reduced so that the bright light, which laminate the work area, is obstructed. In the present embodiment of the disclosure, the stray light in the glare area will be shield by the shade module 5 and does not shot into eye whether person stares at the anti-glare LED lamp or not in contrast of the glare area of the traditional LED lamp. In case of following the formula of $$H_\varphi = \frac{\phi_{max}}{\tan\theta_{max}},$$

the work area can be extend the most thereof since the shade module 5 shields the stray light of the glare area and strictly separates the work area from the glare area, and no stray light shot into eye in any areas. Accordingly, the LED lamp can achieve light distribution as designed without glare under cooperation of the lens module 2 and the shade module 5.

While the disclosure has been described by way of example and in terms of exemplary embodiment, it is to be understood that the disclosure is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An LED lamp comprising:

a house;

a light module mounted in the house, the light module comprising a printed circuit board, and a number of LEDs electrically connected to the printed circuit board; and a light frame disposed in front of the house;

a lens module received in the house and disposed in front of the light module, the lens module comprising a lens base, and a number of lenses disposed on the lens base, the lenses being responsive to the LEDs, and each of the LEDs being disposed on the bottom of the lenses respectively;

a shade module received in the house and disposed in front of the lens module, the shade module comprising a shade base and a plurality of shades disposed on the shade base, the shades being responsive to the lenses, and a bottom of the shades touching the lens base, wherein each of the shades comprises a hole and area of the section of the hole is the same as that of a big end of the lens, the axial height of the hole must meet the following formula:

$$H_\varphi = \frac{\phi_{max}}{\tan\theta_{max}},$$

wherein $\phi_{max}$ is a maximum diameter of the light emitting surface, $\theta_{max}$ is an maximum output angle between light path of light emitted from the outermost boundary of the light emitting surface and the optical axis of the lens.

2. The LED lamp of claim 1, wherein the big end of the lenses is connected to the lens base, and the big end work as a light emitting surface, a LED recess is opened in a small end of each of the lenses along the longitudinal direction, each of the LEDs is received in one of the LED recess respectively.

3. The LED lamp of claim 2, wherein the hole of each of the shades has the circle shape, a radius value of the circle shape equals to the maximum radial of the big end of the lenses.

4. The LED lamp of claim 2, wherein the hole of each of the shades has the elliptic shape, a minor axis of the elliptic shape has a length of equal to the maximum radial of the big end of the lenses.

5. The LED lamp of claim 2, wherein the hole of each of the shades has-a polygon shape, a radial value of incircle of the polygon shape is equal to the maximum radial of the big end of the lenses.

6. The LED lamp of claim 1, wherein the anti-glare LED lamp further comprises a ring, the ring is connected to the shade module and rotates around the shade module, the house further comprises two first pin holes opened on the periphery thereof, the two first pin holes are symmetric with centre axis of the house, connection between the two first pin holes is eccentrically arranged with a centre of the ring, the ring includes two arms formed in an inner side thereof in response to the two first pin holes respectively, each of the two arms includes a second hinge hole opened therein, a shaft crosses through the two first pin holes and the two second hinge holes.

7. The LED lamp of claim 6, wherein a stopper extends towards a center of the ring and two limiting parts perpendicularly extends from a perpendicular side of the light frame toward the center thereof.

8. The LED lamp of claim 7, wherein the stopper is formed in an L-shape, the light frame further comprises two arms extending toward the center thereof along the periphery thereof, and the two limiting parts are located on the two arms respectively and are formed in a reverse L-shape.

9. The LED lamp of claim 1, wherein the house further comprises a heat sink integratly formed therewith, a first through hole is opened in the house along a circumference axis thereof, a second through hole is opened in the print circuit board along the circumference axis of the house, a third through hole is opened in the lens base along the circumference axis of the house, at least one open is form on the bottom of each of the shades.

10. The LED lamp of claim 1, wherein the LED lamp comprises an end cap, the end cap closes the bottom of the shade module, and the diameter of the end cap is equal to that of open of the house.

* * * * *